United States Patent [19]

Pagel

[11] 4,167,928

[45] Sep. 18, 1979

[54] ELECTRONIC DISTRIBUTOR WITH A DECREASED NUMBER OF POWER SWITCHES

[75] Inventor: Ernst-Olav Pagel, Bohmfeld, Fed. Rep. of Germany

[73] Assignee: Robert Bosch GmbH, Stuttgart, Fed. Rep. of Germany

[21] Appl. No.: 897,365

[22] Filed: Apr. 18, 1978

[30] Foreign Application Priority Data

May 26, 1977 [DE] Fed. Rep. of Germany ..... 2723781

[51] Int. Cl.[2] ..... F02P 1/00

[52] U.S. Cl. ..... 123/148 ND; 123/148 E; 123/148 DS

[58] Field of Search ..... 123/148 DS, 148 E, 148 ND; 315/209 T

[56] References Cited

U.S. PATENT DOCUMENTS

| | | | |
|---|---|---|---|
| 3,072,823 | 1/1963 | Kirk | 123/148 E |
| 3,218,512 | 11/1965 | Quinn | 123/148 E |
| 3,253,168 | 5/1966 | Robbins | 123/148 E |

*Primary Examiner*—Ronald B. Cox

*Attorney, Agent, or Firm*—Frishauf, Holtz, Goodman & Woodward

[57] ABSTRACT

For a four cylinder engine, a first and second ignition coil, each having a primary and secondary winding is provided. A first and second electronic switch is connected in series wit the primary winding of each ignition coil and the so-formed series circuits are connected in parallel. A power switch is connected in series with the parallel combination. The power switch is switched to the conductive state a predetermined time interval prior to the ignition time and to the nonconductive state at each ignition time. The series switches are switched to the conductive state alternately during each cycle, but the switching occurs only when the power switch is in the nonconductive state. The on-offswitching of the series switch is controlled by a flip-flop which is clocked at the ignition time and which is initially synchronized to the ignition cycle by a signal derived from a sensor sensing a mark on a rotating shaft in the engine.

6 Claims, 4 Drawing Figures

ELECTRONIC DISTRIBUTOR WITH A DECREASED NUMBER OF POWER SWITCHES

The present invention relates to distributors which operate with electronic switches rather than mechanically moving parts. More particularly, it is the function of such distributors to control the current in at least a first and second ignition coil, each of which in turn creates the ignition voltage required for at least one spark plug.

BACKGROUND AND PRIOR ART

Electronic ignition systems are known. Such a system is, for example, described in SAE Journal No. 760,265 Feb. 23–27, 1976, page 11. The distributor shown therein requires two ignition coils for a four cylinder engine, each ignition coil furnishing a spark to two spark plugs simultaneously. This does not create any difficulty since only one of the cylinders contains an ignitable mixture at the time. The other cylinder is in the exhaust phase. Thus, for internal combustion engine with n cylinders, n/2 ignition coils are required. In the known system a power transistor is associated with each ignition coil. This creates a great expense. The known system is thus not suitable for use in internal combustion engines having a large number of cylinders.

THE INVENTION

It is an object of the present invention to furnish an ignition system wherein only a single power transistor is required, independent of the number of ignition coils. Additional transistors which are connected in series with the primary windings of the ignition coils need not have a high collector breakdown voltage, since they are switched only when the power transistors in the non-conductive state. The high voltage appearing at the collector of the power transistor at the ignition time is blocked from the series transistors by a diode. Only these diodes must be able to absorb the voltage spikes induced when the primary current of the ignition coil is interrupted. In a preferred embodiment, the additional transistors with the associated diodes are replaced by thyristors. Use of a single power transistor, independent of the number of cylinders of the engine, also allows use of only a single stage for calculating the required closure time of the switch, and the ignition angle.

DRAWING ILLUSTRATING A PREFERRED EMBODIMENT

Figure 1:
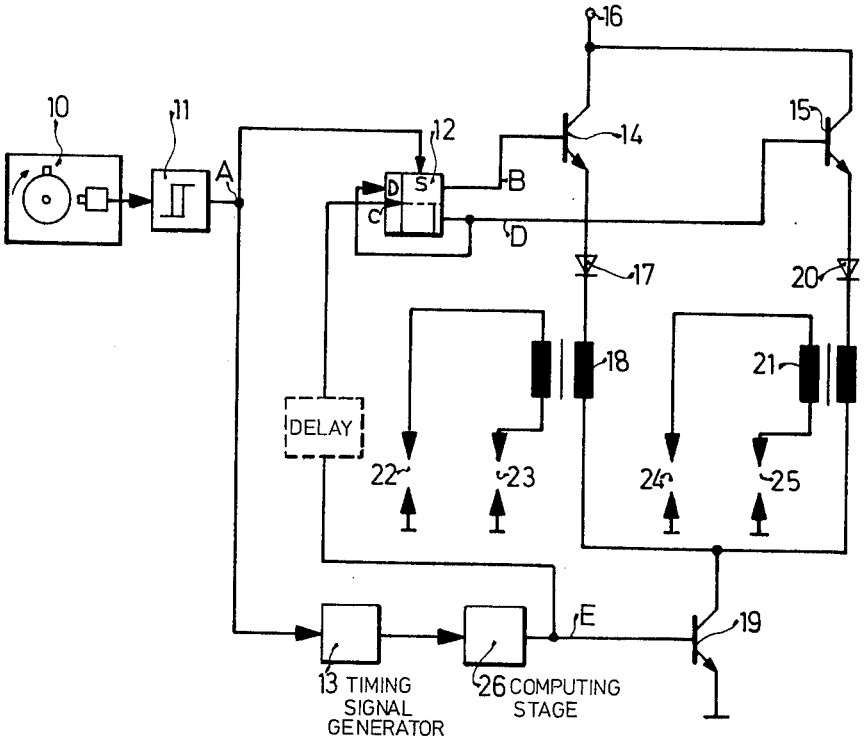
FIG. 1 shows a first embodiment of the invention, suitable for a four cylinder internal combustion engine.

In FIG. 1, an inductive sensor associated with the cam shaft of the engine furnishes pulses at predetermined angles of rotation of the engine. Although the sensor is shown as an inductive sensor, other forms of senors such as interrupter contact, hall generators or optical sensors can be utilized. The sensor output is shaped by a pulse shaping circuit 11 which, in a preferred embodiment, is a Schmitt trigger circuit. The output of pulse shaping circuit 11 is connected to the preset input S of a D flip-flop 12 and serves to synchronize flip-flop 12 to the engine operation at the beginning of operation or following any interruption. When the flip-flop is operating properly, it is in the logic "1" state when the signal from sensor 10 is received.

A first output of flip-flop 12 is connected with a control input of a first transistor 14, whilst a second, complementary output is connected to the control input of the second switching transistor 15. A terminal 16 is connected to the positive output of the supply voltage. It is further connected through the series circuit of the emitter-collector circuit of transistor 14, a diode 17 and a primary winding of the first ignition coil 18 to the collector of a power transistor 19. A series circuit including the emitter-collector circuit of transistor 15, a diode 20 and the primary winding of an ignition coil 21 is connected in parallel with the circuit formed by transistor 14, diode 17 and the primary winding of ignition coil 18. The end terminals of the secondary winding of ignition coil 18 are connected to ground potential through, respectively, spark circuits 22 and 23. The end terminals of the secondary winding of ignition coil 21 are similarly connected to ground potential through spark circuits 24 and 25. In an internal combustion engine, spark circuits 22–25 are spark plugs.

The output of pulse shaping stage 11 is connected to a timing signal furnishing stage whose output is connected to a known standard computing stage 26 for transistorized ignition circuits. The output of stage 26 is connected to the base of a power transistor 19. The emitter of power transistor 19 is connected to reference potential. The output of stage 26 is further connected to the clock input of a flip-flop 12. The electronic timing signal furnishing stage 13 can, for example, be found in DT-OS No. 23 29 046. It is the function of such a stage to furnish additional timing signals in response to the sensed signal applied as its input. These additional timing signals are required for internal combustion engines having a plurality of cylinders. The system shown in FIG. 1, namely the system for a four cylinder internal combustion engine, requires two timing signals, separated by 180° of engine rotation. These additional timing signals could of course also be furnished directly by sensor 10. An electronic computing stage 26 is preferably embodied in an ignition angle computing stage shown in U.S. application Ser. No. 660,858, filed Feb. 24, 1976. Alternatively, a computing circuit which computes the closure angle for switch 19 can be utilized. Such a stage is shown in U.S. Pat. No. 3,881,458. Mechanical arrangements for fixing the ignition angle may also be part of the sensor stage 10.

OPERATION

Figure 2:
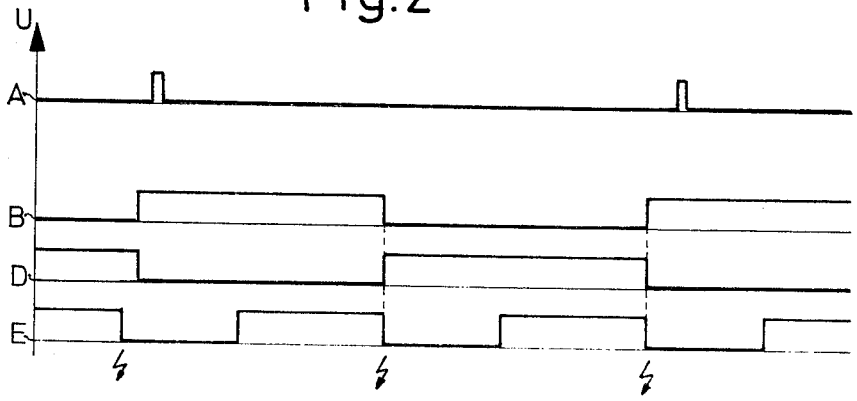
FIG. 2 shows the voltage levels as a function of time at selected points in the circuit of FIG. 1.

The ignition signals are the trailing edges of the pulses shown in line E, of FIG. 2. Each time an ignition signal is furnished, a clock signal appears at the clock input of flip-flop 12. The state of the flip-flop changes in response to each clock signal because of the feedback coupling between the second output and the D input. The signal levels at the bases of transistors 14 and 15 resulting from this alternation and the output of flip-flop 12 are shown in lines B and D. For internal combustion engines having more than four cylinders, logic circuits including a plurality of flip-flops would be supplied to distribute the signals to the corresponding number of switching transistors. The signals B and D cause transistors 14, 15 to be operated such that one is in the conductive state while the other is blocked. During predetermined time intervals, each equal to the pulse width of the positive pulses in line E of FIG. 2, transistor 19 is conductive. A magnetic field is thus generated in the ignition coil (18 or 21,) which is connected to the then-conductive transistor 14 or 15. At the end of pulse E, power switch 19 is switched to the nonconductive state, thereby initiating a spark in either one of spark plugs 22 and 23 or spark plugs 24 and 25.

It is the main principle of the present invention, that while transistors 14 or 15 are being switched, transistor 19 is nonconductive. Transistors 14 and 15 are therefore only switched when no current flows through them. In a preferred embodiment, therefore, a slight delay is introduced between the actual ignition time and the time of switching of transistors 14 and 15. This delay can either be inherent in flip-flop 12 or be an additional delay generated by a delay circuit interconnected between the output of stage 26 and the clock input of flip-flop 12. The delay cannot under any circumstances exceed the time interval between the trailing edge of pulse E and the next subsequent leading edge.

Diodes 17 and 20 block the high voltages appearing at the collector of transistor 19 at the ignition time from transistors 14 and 15, respectively. These diodes must therefore be able to withstand the high voltage spikes generated upon termination of the current through the ignition coils.

Figure 3:
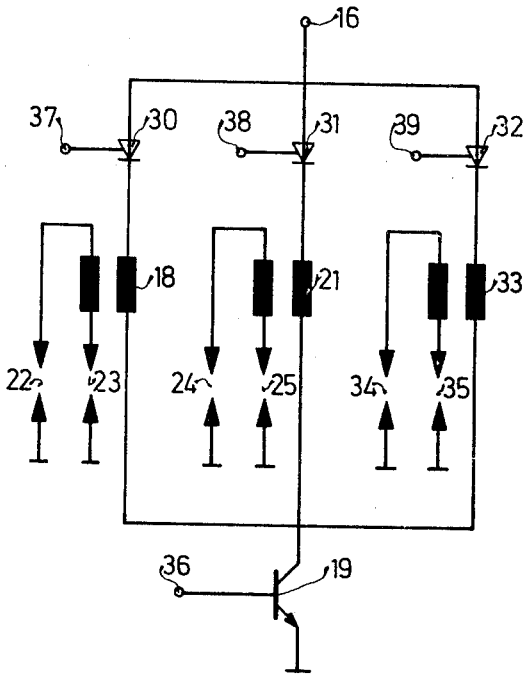
FIG. 3 is a second embodiment of the invention, suitable for a six cylinder internal combustion.

FIG. 3 shows a second embodiment of the present invention, suitable for a six cylinder internal combustion engine. Ignition coils 18 and 21 are identical to those shown in FIG. 1. The combination of transistor 14 and diode 17 has been replaced by a thyristor 30, while the combination of transistor 15 and diode 20 has been replaced by a thyristor 31. A third ignition coil 33 has a primary winding connected in series with the output circuit of thyristor 32. The series combination of thyristor 32 and the primary winding of ignition coil 33 is connected in parallel with the parallel combination formed by the other ignition coils and associated thyristors. The secondary winding of ignition coil 33 is connected to two spark circuits 34, 35. A terminal 36 connected to the base of transistor 19 is connected to the output of a stage 26 as in FIG. 1. Terminals 37, 38 and 39, connected to the control electrodes of thyristors 30–32 respectively are connected to the output of a logic circuit including a plurality of flip-flops, in a preferred embodiment a counter-decoder combination which is commercially available. The signal A in FIG. 1 is used to reset the counter. Also as in FIG. 1 the trailing edge of pulses E serve to advance the count on the counter. The decoder outputs control the individual thyristors 30–32. In this way any number of ignition coils can be activated in a desired sequence.

Figure 4:
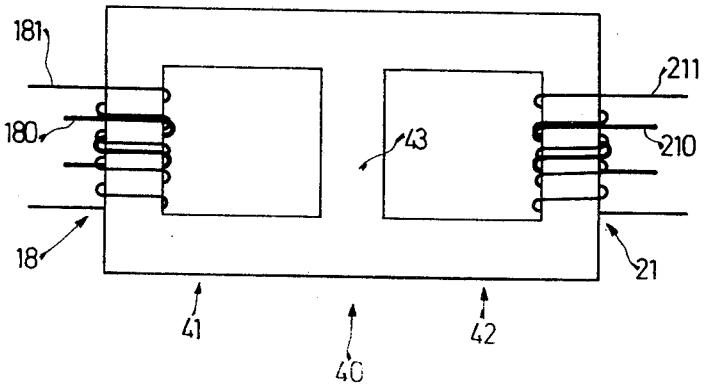
FIG. 4 shows an arrangement of a plurality of ignition coils on a single core.

An arrangement showing two ignition coils, 18, 21 on a common iron core 40 is shown in FIG. 4. The common core consists of essentially two rectangular cores having a common center leg. Coil 18 has a primary winding 180 and a secondary winding 181. Ignition coil 21 has a primary winding 210 and a secondary winding 211. The primary flux of ignition coil 18 will, in the main, flow through center leg 43. Only a small amount of stray inductance will go through part 42 of the common core. The reluctance of the central leg 43 must be low relative to the reluctance of the side portion 41 and 42. When the primary current in coil 18 is interrupted, the stray flux through region 42 of the core is insufficient to generate an ignition voltage in the secondary winding 211 of coil 21. However, the flux in region 41 is sufficient for an ignition voltage to be generated in secondary winding 181. Of course the same considerations hold for an interruption in the primary winding of coil 21.

Additional coils can be accommodated in the same fashion on, for example, a common core shaped as a star around center leg 43.

Various changes and modifications may be made within the scope of the inventive concept.

I claim:

1. Electronic distributor for creating an ignition voltage at a first and second time instant in an ignition cycle across the secondary winding of a first and second ignition coil, respectively, by interrupting the current through the primary winding of said first and second ignition coil, respectively, comprising, in accordance with the invention, first and second switch means (14, 15) connected in series with the primary winding of said first and second ignition coil (18, 21) respectively, thereby forming a first and second series circuit;

means for connecting said first and second series circuit in parallel;

power switch means (19) connected in series with the so-formed parallel circuit;

first control means (10, 11, 13, 26) connected to said power switch means for switching said power switch means to the nonconductive state at each desired ignition time within said cycle, and to the conductive state a predetermined time interval preceeding each of said desired ignition time;

and second control means (12) connected to said first control means and said first and second switch means, for switching said first and second switch means from the conductive to the nonconductive and from the nonconductive to the conductive state only when said power switch means is in the nonconductive state, whereby switching of said first and second switch means takes place only when substantially zero current is flowing therethrough.

2. Distributor as set forth in claim 1, further comprising a first and second diode (17, 20) connected in series with said first and second switch means, respectively, for blocking the voltage induced in the respective one of said primary windings at the ignition time from said switch means.

3. A distributor as set forth in claim 1, wherein said second control means comprises a bistable circuit having a first (B) and second (D) output connected, respectively, to said first and second switch means, and a clock input and a synchronizing input connected to said first control means.

4. A distributor as set forth in claim 1, further comprising a third ignition coil (33), having a primary winding and a secondary winding, third switch means (32) connected in series with said primary winding of said third ignition coil thereby forming a third series circuit, and means connecting said third series circuit in parallel with said first and second series circuit;

and wherein said first, second and third switch means each comprises a thyristor.

5. A distributor as set forth in claim 4, wherein each of said thyristors have a gate;

and wherein said second control means comprises a counter having a first, second and third counting output connected, respectively to the gate of said first, second and third thyristor.

6. A distributor as set forth in claim 1, wherein said primary and secondary windings of said first and second ignition coil are wound on a single transformer core having a plurality of legs.

* * * * *